United States Patent [19]

Johnson et al.

[11] 4,095,526

[45] Jun. 20, 1978

[54] MECHANICAL HYDRAULIC COUNTING AND MEMORY DEVICE

[75] Inventors: Virgil H. Johnson; David I. Parker, both of Champaign, Ill.

[73] Assignee: The Magnavox Company, Fort Wayne, Ind.

[21] Appl. No.: 483,390

[22] Filed: Aug. 26, 1965

[51] Int. Cl.[2] ..... F42B 23/06; F42B 23/26

[52] U.S. Cl. ..... 102/8; 102/16

[58] Field of Search ..... 60/54.5, 54.6, 54.6 A, 60/54.6 HA; 102/8, 10, 16

[56] References Cited

U.S. PATENT DOCUMENTS

| | | | |
|---|---|---|---|
| 2,450,407 | 10/1948 | Bartgis | 102/8 |
| 2,477,882 | 8/1949 | LaBrie | 277/97 |
| 2,603,067 | 7/1952 | Nissin | 60/547 |
| 2,820,347 | 1/1958 | Highland et al. | 60/578 |

*Primary Examiner*—David H. Brown

[57] ABSTRACT

Upper and lower separate pistons confining a constant volume of liquid in upper and lower chambers separated by a horizontal partition. A valve closing an aperture in the partition and opened by liquid in upper chamber moving to lower chamber when upper piston is pushed downwardly, the lower piston being moved downward by the liquid thus added to lower chamber. Orifice in valve permitting coil spring on lower piston to slowly raise lower piston and thereby return liquid from lower to upper chamber while valve is closed and downward push is absent from upper piston. A normally-open switch in electric fuze circuit, closable by lower piston upon attainment of a predetermined downward displacement, the upper piston being downwardly pushable through a one-way clutch by a plunger downwardly pushable by an external force and upwardly returned by an internal coil spring.

7 Claims, 2 Drawing Figures

MECHANICAL HYDRAULIC COUNTING AND MEMORY DEVICE

This invention relates generally to counting devices and more particularly to a device responding to a certain number of mechanical displacements of an input member received within a certain time and having a certain total amplitude to produce an output displacement of a predetermined amount.

There are many instances in the useful arts where it is desirable to perform a function after a certain number of inputs having a certain total magnitude and received within a certain period of time. It is frequently desirable to have such devices reset to their original condition in the event that there is a failure of the required number, amplitude, or frequency of inputs. In certain applications it is desirable that the inputs be in the form of mechanical displacements of an input member and that the output be in the form of a mechanical displacement of an output member which will perform a certain function upon reaching a certain magnitude. An example of a use of such a device is in an anti-tank mine fuze where a pressure or force sensing input member responds to external impulses and upon receipt of a certain number within a certain time will activate a mine.

It is, therefore, a general object of the present invention to provide a device for counting mechanical displacements and performing a function following a number of displacements.

A further object is to provide a device achieving the foregoing objects and which will reset if the pulsing sequence is initiated but not completed within a certain period of time.

A further object is to provide a device achieving the foregoing objects and characterized by simplicity and reliability of construction.

Described briefly, in a typical embodiment of the present invention, an input member is provided in a body, the input member being in the form of a plunger having a ball clutch engageable with a first hydraulic piston. The output member is connected to a second hydraulic piston and is disposed to perform a function when it is displaced a certain amount.

Depression of the input plunger causes the clutch to engage the first piston and displace it which causes hydraulic fluid in the device to displace the second piston and thereby the output member is displaced. When the input pulse is removed from the plunger, the clutch disengages and a spring load on the output member tends to return it to initial position, which action is delayed by a valve and orifice in the hydraulic return path. Thus the next impulse on the input member can cause the clutch to engage the first piston at a different point whereby the displacement of both pistons from their initial position will be greater at the end of the second impulse than it was at the end of the first. In the event there is failure of additional impulses within a predetermined time, the orifice will allow the output member to return to initial position.

The full nature of the invention will be understood from the accompanying drawings and the following description and claims.

Figure 1:
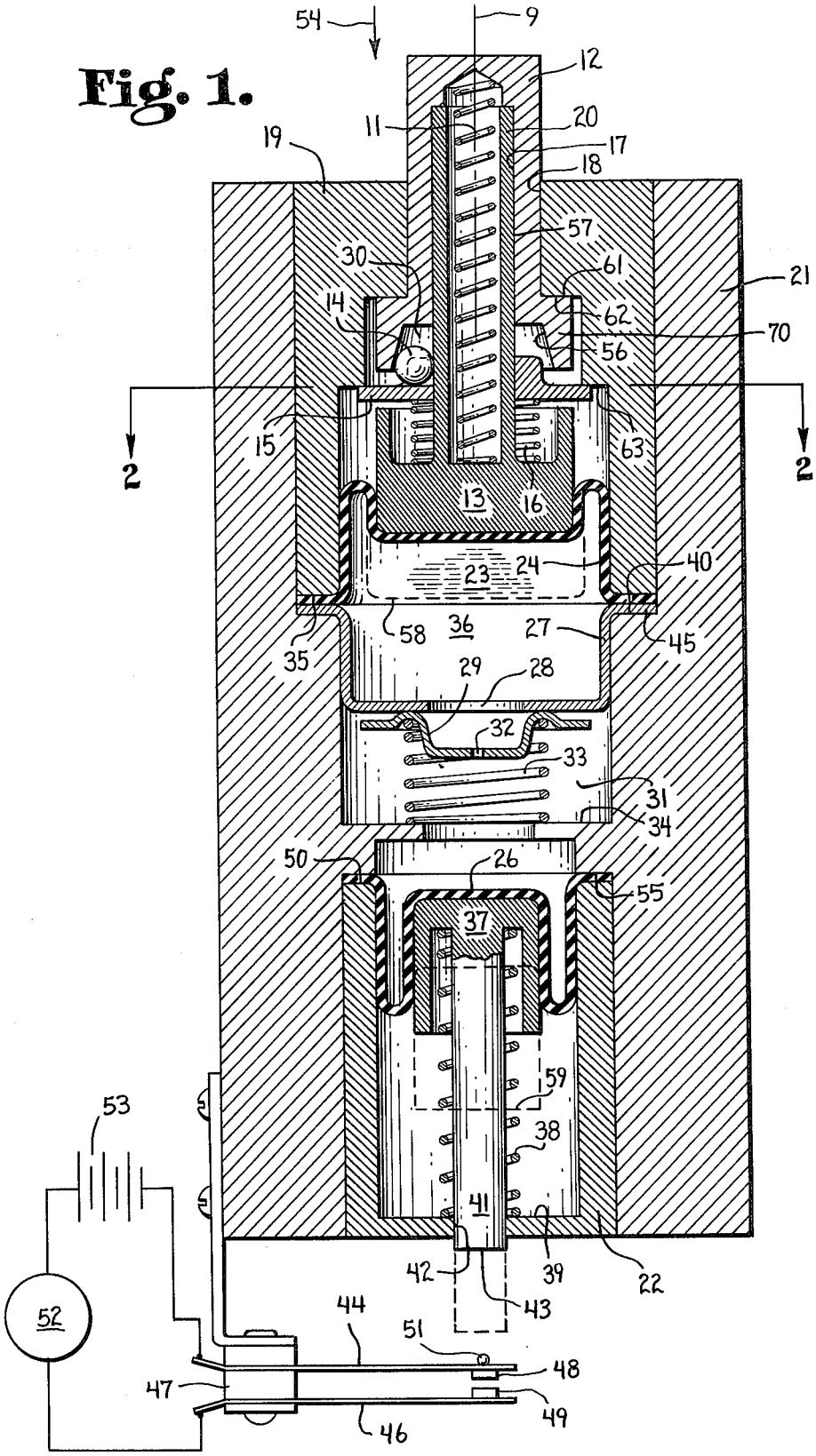
FIG. 1 is a section through a typical embodiment of the device, with the section being taken on a vertical plane containing an axis of symmetry of the device.
Figure 2:
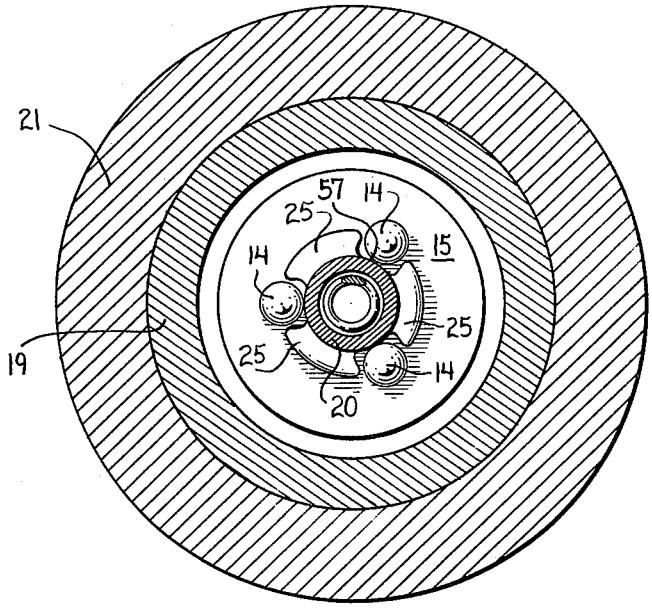
FIG. 2 is a section taken along the line 2—2 in FIG. 1 and viewed in the direction of the arrows.

Referring now to the drawings in detail, the device is illustrated by the solid outlines in its initial equilibrium condition. Most of the parts are generally cylindrical in nature and therefore symmetrical with respect to a vertical axis 9. The parts include a plunger bias coil spring 11 acting upwardly on the plunger 12 and downwardly on the input piston 13. Three balls 14 are equally spaced in a circle by the ball retainer 15 and a ball retainer bias spring 16 is provided between the retainer 15 and the input piston 13. The upstanding stem of input piston 13 and in which the plunger bias spring 11 is disposed, is slidingly received in the plunger bore 17 and the plunger is slidingly received in the bore 18 of the input cap 19.

The input cap 19 is secured in the body 21 and an output cap 22 is also secured in the body. Hydraulic fluid 23 is confined in the body by an upper rolling diaphragm 24 and a lower rolling diaphragm 26. A valve seat member 27 is secured to said body and has an aperture 28 in the bottom thereof.

The valve seat member has a radially extending annular flange 45 sandwiched between an upwardly facing annular shelf 40 of said body and the outer marginal portion of said upper diaphragm, this marginal portion being sandwiched between the flange and the annular lower marginal edge 35 of said upper cap. In this way the body, upper cap, valve seat member, and rolling diaphragm are sealingly affixed together in a circle at the flange 45. Similarly the outer marginal portion of the lower rolling diaphragm is sandwiched between the annular upper marginal edge 50 of the lower cap and the annular shelf 55 of the body 21.

Check valve 29 is disposed in the chamber 31 below the valve seat member 27 and has an aperture 32 therein. Aperture 32 is actually an orifice for obtaining the desired time delay as will be described hereinafter. Coil spring 33 disposed between the check valve and the lower face 34 of chamber 31 normally biases the check valve closed as shown whereupon the only communication between the chamber 31 below the valve seat member 27 and chamber 36 above the valve seat member 27 is through the orifice 32.

Output piston 37 supports the central portion of the lower rolling diaphragm 26 by means of the coil spring 38 which is the output piston return spring. The lower end of this spring engages the inside face 39 of the bottom of the output cap 22, and the stem 41 of the output piston extends through a guiding aperture 42 in the output cap.

As will be described hereinafter, it is a certain amount of displacement of the output piston which is required to perform some function in response to a sequence of depressions of the plunger 12. One way of performing a function is by providing an electric switch below the lower end 43 of the output piston stem. This switch includes upper and lower spring leaf contactors 44 and 46, respectively, mounted by means of an insulated block 47 to the body 21. The contact points 48 and 49 are normally open but can be closed when the lower end 43 engages the ball 51 mounted to the upper leaf to depress it. Closure of the contacts completes a circuit through the battery 53 and a load 52 which could be the initiator for a mine fuze, for example.

OPERATION

In the operation, when the plunger is forced down in the direction of the arrow 54 by some external force, the inner conical surface 56 of the axially extending flange 70 thereof engages the balls 14, which are circularly spaced by retainer fingers 25 and disposed to project into the downwardly opening recess 30 of the plunger. The surface 56 thereupon urges the balls inwardly against the outer cylindrical surface 57 of the upper piston stem 20. As the downward force applied by the plunger on the balls reaches the opposing force transmitted by the ball retainer bias spring 16 through the retainer to the balls, the balls jam against the piston stem and the piston is forced downward displacing the rolling diaphragm 24, which displaces the hydraulic fluid 23. Rapid displacement of the hydraulic fluid is enabled by opening of the check valve 29 as the hydraulic pressure in chamber 36 forces the valve away from its seat. The hydraulic fluid displaces the output piston 37 by means of the rolling diaphragm 26. The output piston moves downwardly a distance determined by the length of the input stroke and the relative areas of the output piston and the input piston. For example, if the input piston is displaced to the position shown by the dotted outline 58, the output piston may be displaced to the position shown by the dotted outline 59. Note that this amount of displacement of the output piston is not sufficient to engage the ball 51 and close the switch contacts 48 and 49.

When the plunger is released, downward displacement of the hydraulic fluid ceases and the spring 33 closes check valve 29. Plunger bias spring 11 forces the plunger 12 up against the stop provided by abutment between the faces 61 and 62 of the plunger and the upper cap, respectively. The ball retainer spring 16 forces the ball retainer 15 and the balls 14 to follow the plunger 12 upwardly until the retainer is stopped by the ledge 63 on the input cap 19. The stopping of the ball retainer by the ledge on the input cap prevents the balls from remaining tightly engaged with the piston and plunger and therefore allows relative vertical motion between the plunger 12 and upper piston 13.

The output piston spring 38 forces the piston 37 upwardly, which forces hydraulic fluid in the chamber 31 upward through the orifice 32 in the check valve. The orifice restricts the hydraulic flow and controls the rate of return of the output piston toward its initial position. The slowly moving hydraulic fluid forces the input piston 13 upwardly slowly toward its initial position.

When the plunger 12 is again depressed downwardly, the balls again engage the stem and the action is repeated as described above. However, if the plunger is depressed downwardly before the upper piston 13 has returned to its initial position, the balls grip the stem at points above the points of first contact and cause the upper and lower pistons to move downwardly to points at greater downward displacements from their original positions than occurred during the first depression of the plunger. If this occurs one or two more times, the lower end 43 of the lower piston will close the switch contacts. On the other hand, if the input pulses on the plunger are of such small magnitude or are spaced sufficiently apart in time, both the upper and lower pistons will return to their initial rest positions and closure of the switch contacts 48 and 49 will not occur.

It can be seen that by employing a switch or other sensor for actuation by the output piston upon a certain predetermined displacement, and if the input pulses are of a certain displacement, the position of the output piston is representative of the number of input pulses. The device is, in effect, a counter.

It is believed that from the foregoing description the novelty and utility of the present invention are apparent. While the invention has been disclosed and described in some detail in the drawings and foregoing description, they are to be considered as illustrative and not restrictive in character, as other modifications may readily suggest themselves to persons skilled in this art and within the broad scope of the invention, reference being had to the appended claims.

The invention claimed is:

1. A mechanical-hydraulic counting and memory device comprising:

a body having upper and lower cylindrical bores therein with a cavity providing communication between the upper and lower bores, the upper bore opening at the upper end of said body and the lower bore opening at the lower end of said body;

an upper generally cylindrical cap received in said upper bore and affixed to said body;

a generally cylindrical lower cap received in said lower bore and affixed to said body;

a generally cylindrical plunger received in a central guide bore in said upper cap, said upper cap having a first stop face extending radially outward from the lower margin of said central guide bore, said plunger having a first radially extending abutment abuttingly engaging said stop face and said plunger having a flange extending axially from said abutment, said flange providing a downwardly opening recess therein with the inner wall of said flange being conical and tapering upwardly and inwardly;

an upper piston having an upwardly extending stem received in a central bore of said plunger;

a ball retainer below said plunger and having a radially extending flange engaging a downwardly facing ledge in said upper cap, said retainer having upwardly projecting retainer fingers positioning three balls in equally spaced relationship around a circle, the balls projecting into said recess and being disposed between a portion of the axially extending flange of said plunger and the stem of said upper piston;

a retainer return coil spring received around said upper piston stem and having a lower end seated on said upper piston and having an upper end urging said retainer upwardly, said plunger being movable downward toward said retainer to thereby move said balls inwardly into engagement with the stem of said piston and jam said stem for driving said piston downwardly, said first stop face and said ledge on said body being vertically spaced apart sufficiently to provide clearance between said balls and said stem when said retainer engages said ledge and said plunger abutment engages said first stop face and thereupon permit upward movement of said first piston relative to said plunger;

an upper rolling diaphragm extending across said upper cap at the lower marginal edge thereof, the outer marginal portion of said diaphragm extending under a complete circle of said lower marginal edge and thereby sealingly sandwiched and secured between the upper cap and a first annular upwardly facing shelf of said body, said rolling diaphragm having a portion extending upwardly along the wall of a lower cylindrical bore of said upper cap and portions extending downwardly and across the lower face of said piston thereby defining the ceiling of a hydraulic liquid containing chamber in said body;

a valve seat member extending across said body below said upper rolling diaphragm and having an aperture therethrough, said valve seat member having a radially extending flange sandwiched between said first annular shelf and said outer marginal portion of said upper diaphragm;

a check valve abuttingly engaging the lower face of said valve seat member and covering said aperture, said valve and seat member thereby dividing the space below said upper rolling diaphragm into an upper hydraulic chamber and a lower hydraulic chamber;

a coil spring in said lower hydraulic chamber and normally holding said valve in aperture-closing abutting engagement with said valve seat member, said valve having a metering orifice therein;

a lower piston;

a lower rolling diaphragm extending across said lower cap at the upper marginal edge thereof and having an outer marginal portion extending on top of a complete circle of said upper marginal edge and thereby sealingly sandwiched and affixed between said lower cap and a second annular downwardly facing shelf of said body, said lower diaphragm closing the lower end of said chamber and having a portion extending downwardly along the wall of a cylindrical bore of said lower cap and having portions extending inwardly therefrom and upwardly and across the upper face of said lower piston thereby defining the floor of said lower chamber, said lower piston having a stem extending through a guide aperture in the lower end of said lower cap;

a lower piston return spring received around the stem of said lower piston and engaging the inside face of the lower end of said lower cap and urging said lower piston upwardly;

a switch assembly including an actuator in vertically spaced relationship to the lower end of said lower piston stem and spaced therebelow, said switch being normally open and being in circuit relationship with a source of electrical energy and a load, said actuator being engageable and downwardly movable by the lower end of said lower piston stem to close said switch;

said plunger being operable downwardly by a downwardly directed external force to jam said balls between said conical wall and the stem of said upper piston and drive said upper piston downwardly to move hydraulic fluid from the upper chamber through said valve aperture into said lower chamber, and thereby move said lower piston downwardly;

a plunger bias spring seated in said upper piston and extending upwardly inside the stem of said upper piston and urging said plunger upwardly from said upper piston whereby said plunger is returned to said initial rest position after removal of said external force therefrom, said lower piston return spring urging said lower piston upwardly and thereby urging said hydraulic fluid through the metering orifice of said valve when the said external downwardly directed force is removed from said plunger to thereby move said upper piston upwardly at a rate determined by the rate of flow of hydraulic fluid through said orifice;

said plunger being movable downwardly successively by successive applications of downwardly directed external force thereto to jam said balls on said stem of said upper piston at successively higher points when the total displacement of successive applications of external force within a predetermined time span exceeds a predetermined amount to ultimately cause a certain predetermined displacement of said lower piston downwardly to close said switch and complete the circuit through said energy source and said load.

2. A mechanical-hydraulic counting and memory device comprising:

a body having upper and lower receivers therein with a cavity providing communication between the upper and lower receiver, the upper receiver opening at the upper end of said body and the lower receiver opening at the lower end of said body;

an upper cap received in said upper receiver and affixed to said body;

a lower cap received in said lower receiver and affixed to said body;

a plunger received in a guide in said upper cap, said upper cap having a first stop extending radially outward from the lower margin of said guide, said plunger having a first radially extending abutment abuttingly engaging said stop when said plunger is in an initial rest position, said plunger having a flange extending axially from said abutment, said flange providing a downwardly opening recess therein with an inner wall of said axially extending flange tapering upwardly and inwardly;

an upper piston having an upwardly extending stem received in a central bore of said plunger;

a ball retainer below said plunger and having a radially extending flange engaging a downwardly facing ledge in said upper cap and retaining a ball between a portion of the axially extending flange of said plunger and the stem of said upper piston;

a retainer return spring seated on said upper piston and urging said retainer upwardly, said plunger being movable downwardly toward said retainer to thereby move said ball inwardly into engagement with the stem of said piston and jam said balls against said stem for driving said piston downwardly, said first stop face and said ledge on said body being vertically spaced apart sufficiently to provide clearance between said ball and said stem when said retainer engages said ledge and said plunger abutment engages said first stop face, and thereupon permit upward movement of said upper piston relative to said plunger;

an upper rolling diaphragm extending across said upper cap, said rolling diaphragm having a portion extending upwardly along the wall of a lower cylindrical bore of said upper cap and portions extending downwardly and across the lower face of said piston thereby defining the ceiling of a hydraulic liquid containing chamber in said body;

a valve seat member extending across said body below said upper rolling diaphragm and having an aperture therethrough;

a valve abuttingly engaging the lower face of said valve seat member and covering said aperture, said valve and seat member thereby dividing the space below said upper rolling diaphragm into an upper hydraulic chamber and a lower hydraulic chamber;

a spring normally holding said valve in abutting engagement with said valve seat member, said valve having a metering orifice therein;

a lower piston;

a lower rolling diaphragm extending across said lower cap, said lower diaphragm closing the lower end of said chamber and having a portion extending downwardly along the wall of a cylindrical bore of said lower cap and having portions extending inwardly therefrom and upwardly and across the upper face of said lower piston thereby defining the floor of said lower chamber, said lower piston having a stem extending through a guide aperture in said lower cap;

a lower piston return spring urging said lower piston upwardly;

switch means including an actuator spaced below a portion of said lower piston stem, said switch being normally electrically open and in circuit relationship with a source of electrical energy and a load, said actuator being engageable and movable by said lower piston stem portion to close said switch means;

said plunger being operable downwardly by a downwardly directed external force to jam said ball between said tapering wall and the stem of said upper piston and drive said upper piston downwardly to move hydraulic fluid from the upper chamber through said valve aperture into said lower chamber, and thereby move said lower piston downwardly;

a plunger bias spring urging said plunger upwardly from said upper piston whereby said plunger is returned to said initial rest position after removal of said external force therefrom said lower piston return spring urging said lower piston upwardly and thereby urging said hydraulic fluid through the metering orifice of said valve when the said external downwardly directed force is removed from said plunger to thereby move said upper piston upwardly at a rate determined by the rate of flow of hydraulic fluid through said orifice;

said plunger being movable downwardly successively by successive application of downwardly directed external force thereto to jam said balls on said stem of said upper piston at successively higher points when the total displacement of successive application of external force within a predetermined time span exceeds a predetermined amount to ultimately cause a certain predetermined displacement of said lower piston downwardly to close said switch and complete the circuit through said energy source and load.

3. A mechanical-hydraulic counting and memory device comprising:

a body having upper and lower receivers therein with a cavity providing communication between the upper and lower receivers, the upper receiver opening at the upper end of said body and the lower receiver opening at the lower end of said body;

an upper cap received in said upper receiver and affixed to said body;

a lower cap received in said lower receiver and affixed to said body;

a plunger received in a guide in said upper cap, said upper cap having a first downwardly facing stop face thereon, said plunger having an upwardly facing abutment engaging said stop face when said plunger is in an initial rest position, said plunger having a downwardly opening recess with an internal wall tapering upwardly and inwardly;

an upper piston having an upwardly extending stem received in a bore of said plunger;

a clutch retainer below said plunger and having a stop portion engaging a second downwardly facing stop face of said upper can and retaining a clutch member between a portion of the tapering wall of said plunger and the stem of said piston;

a retainer return spring seated on said upper piston and urging said retainer upwardly, said plunger being movable downwardly toward said retainer to thereby move said clutch member inwardly into engagement with the stem of said piston and jam said clutch member against said stem for driving said piston downwardly, said first and second stop faces being spaced vertically on said body a sufficient distance apart to provide clearance between said clutch member and said stem when said retainer engages said second stop face and said plunger abutment engages said first stop face, and thereupon permit upward movement of said upper piston relative to said plunger;

an upper diaphragm extending across said upper cap, and across the lower face of said upper piston thereby defining the ceiling of a hydraulic liquid containing chamber in said body;

a valve seat member extending across said body below said upper diaphragm and having an aperture therethrough;

a valve engaging a lower face of said valve seat member and covering said aperture, said valve and seat member thereby dividing the space below said upper rolling diaphragm into an upper hydraulic chamber and a lower hydraulic chamber;

a spring normally holding said valve in engagement with said valve seat member, said valve having a metering orifice therein;

a lower piston;

a lower rolling diaphragm extending across said lower cap and across the upper face of said lower piston thereby defining the floor of said lower chamber, said lower piston having a stem extending through a guide aperture in said lower cap;

a lower piston return spring urging said lower piston upwardly;

said plunger being operable downwardly by a downwardly directed external force applied thereto to jam said clutch ball member between the tapering wall of said recess and the stem of said upper piston and drive said upper piston downwardly to lower said ceiling of said upper chamber and thereby move hydraulic fluid from the upper chamber through said valve aperture into said lower chamber, and thereby move said lower piston downwardly;

a plunger bias spring urging said plunger upwardly from said upper piston whereby said plunger is returned to said initial rest position after removal of said external force therefrom, said lower piston return spring urging said lower piston upwardly and thereby urging said hydraulic fluid through the metering orifice of said valve when the said external downwardly directed force is removed from said plunger to thereby move said upper piston upwardly at a rate determined by the rate of flow of hydraulic liquid through said orifice;

said plunger being movable downwardly successively by successive applications of downwardly directed external force thereto to jam said clutch member on said stem of said upper piston at successively higher points when the total displacement of successive applications of external force within a predetermined time span exceeds a predetermined amount to ultimately cause the downward displacement of said lower piston to reach a predetermined effective value.

4. A mechanical-hydraulic counting and memory device comprising:

a body having a cavity therein;

a plunger member received in a guide in said body, said body having a first downwardly facing stop face therein, said plunger member having an upwardly facing abutment engaging said stop face when said plunger is in an initial rest position;

an upper piston member having upwardly extending guide means guided on said plunger member, said members having facing surfaces converging upwardly;

a clutch retainer below said plunger and having a stop portion engaging a second downwardly facing stop face of said body and retaining a clutch member between said converging surfaces of said plunger member and said piston member;

a retainer return spring seated on said upper piston member and urging said retainer upwardly, said plunger member being movable downwardly toward said retainer to thereby jam said clutch member between said converging surfaces for driving said piston member downwardly, said stop faces being spaced vertically in said body a sufficient distance apart to provide clearance between said clutch member and said converging surfaces when said retainer engages said second stop face and said plunger member abutment engages said first stop face, and thereupon permit upward movement of said upper piston member relative to said plunger member;

a first seal extending across said cavity and across a lower face of said piston thereby defining the ceiling of a hydraulic liquid containing chamber in said body;

a partition extending across said cavity below said ceiling and dividing the cavity space below said ceiling into an upper hydraulic chamber and a lower hydraulic chamber;

a normally closed valve operable when opened to facilitate movement of liquid from said upper chamber to said lower chamber;

a metering orifice permitting limited communication of liquid between said chambers when said valve is closed, a lower piston;

a second seal extending across said cavity below said partition and across an upper face of said lower piston thereby defining the floor of said lower chamber;

a lower piston return spring urging said lower piston upwardly;

said plunger member being operable downwardly by a downwardly directed external force applied thereto to jam said clutch member between said converging surfaces and drive said upper piston member downwardly to open said valve and move hydraulic fluid from the upper chamber through said valve into said lower chamber, and thereby move said lower piston downwardly;

a plunger bias spring urging said plunger member upwardly from said upper piston member whereby said plunger is returned to said initial rest position after removal of said external force therefrom said lower piston return spring urging said lower piston upwardly and thereby urging said hydraulic liquid through the metering orifice when the downward force is removed from said plunger to thereby move said upper piston member upwardly at a rate determined by the rate of flow of hydraulic liquid through said orifice.

5. An integrator comprising:

a housing;

an input member and an output member in said housing;

a liquid confined in a space in said housing between said input member and said output member;

a first flexible seal connected to said input member and to said housing and defining a first movable wall of said space confining said liquid;

each of said members being thereby adapted to move the other of said members by movement of said liquid;

a unidirectional flow metering device in said space, said device dividing said space into a first chamber and a second chamber, said metering device being oriented to permit substantially unimpeded liquid flow therethrough from said first chamber to said second chamber when external force applied to said input member moves said input member toward said metering device to decrease the volume of said first chamber, and said metering device being oriented to restrict liquid flow therethrough from said second chamber to said first chamber when an external force applied to said output member moves said output member toward said metering device to decrease the volume of said second chamber;

an input actuator, said actuator having a normal rest position in said housing;

a one-way clutch engaging said actuator and said input member and transmitting an externally applied force from said actuator to said input member, to decrease the volume of said first chamber and thereby move said second member, clutch release means returning said actuator to normal rest position after removal of the externally applied force from said actuator;

and output member return biasing means in said housing applying a force to said output member moving it toward said metering device when said clutch release means have returned said actuator to normal rest position.

6. An integrator as set forth in claim 5 wherein:

said clutch release means includes a spring received in said input member and seated therein and engaging said actuator and urging said input member and said actuator in opposite directions.

7. A memory device comprising:

a housing;

an input member and an output member in said housing;

a liquid confined in a space in said housing;

a first flexible seal connected to said input member and to said housing and defining a first movable wall of said space confining said liquid;

a second flexible seal connected to said output member and to said housing and defining a second movable wall of said space confining said liquid;

a partition in said space between said walls and dividing said space into a first chamber and a second chamber;

a normally closed valve operable when opened to facilitate liquid flow from said first chamber to said second chamber;

metering means permitting only a limited rate flow of liquid from said second chamber to said first chamber;

an input actuator having an initial rest position in said housing;

a clutch coupling said actuator to said input member when said actuator is moved toward said input member, thereby enabling said actuator to drive said input member toward said partition and reduce the volume of said first chamber, said clutch being automatically releasable upon movement of said actuator away from said input member;

and means maintaining a released condition of said clutch when said input actuator is in said initial rest position.

* * * * *

UNITED STATES PATENT AND TRADEMARK OFFICE

CERTIFICATE OF CORRECTION

PATENT NO. : 4,095,526

DATED : June 20, 1978

INVENTOR(S) : Virgil H. Johnson and David I. Parker

It is certified that error appears in the above-identified patent and that said Letters Patent are hereby corrected as shown below:

Column 8, line 9, "can" should be ---cap---.

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*